United States Patent [19]

Odekirk

[11] 4,294,422

[45] Oct. 13, 1981

[54] GUTTER HANGER

[76] Inventor: William H. Odekirk, 7446 Gatewood Rd., SW., Seattle, Wash. 98136

[21] Appl. No.: 78,295

[22] Filed: Sep. 24, 1979

[51] Int. Cl.[3] ..... E04D 13/06

[52] U.S. Cl. ..... 248/48.2; 248/216.1; 248/547

[58] Field of Search ..... 248/48.1, 48.2, 547, 248/71, 216.1; 52/16, 95, 96

[56] References Cited

U.S. PATENT DOCUMENTS

| | | | |
|---|---|---|---|
| 1,855,241 | 4/1932 | Irwin | 248/48.2 |
| 3,053,491 | 9/1962 | Ramser | 248/48.2 |
| 3,295,803 | 1/1967 | Blayden | 52/95 X |
| 3,416,760 | 12/1968 | Sauder | 248/48.2 |
| 3,737,127 | 6/1973 | Maloney | 248/48.2 |
| 4,169,570 | 10/1979 | Morin | 248/48.2 |
| 4,210,301 | 7/1980 | Weiss | 248/48.2 |

FOREIGN PATENT DOCUMENTS

| | | | |
|---|---|---|---|
| 208632 | 5/1956 | Australia | 248/48.1 |

*Primary Examiner*—J. Franklin Foss

*Attorney, Agent, or Firm*—David L. Garrison; Ford E. Smith

[57] ABSTRACT

A one-piece gutter hanger bracket has a nail guide portion located in its mid-section. The nail guide positions the head of a nail angularly upward with respect to the main body of the hanger bracket so that the nail head is easily accessible to a driving tool. A nail driven through the nail guide provides additional support to the mid-section of the bracket.

8 Claims, 3 Drawing Figures

Fig. 1.
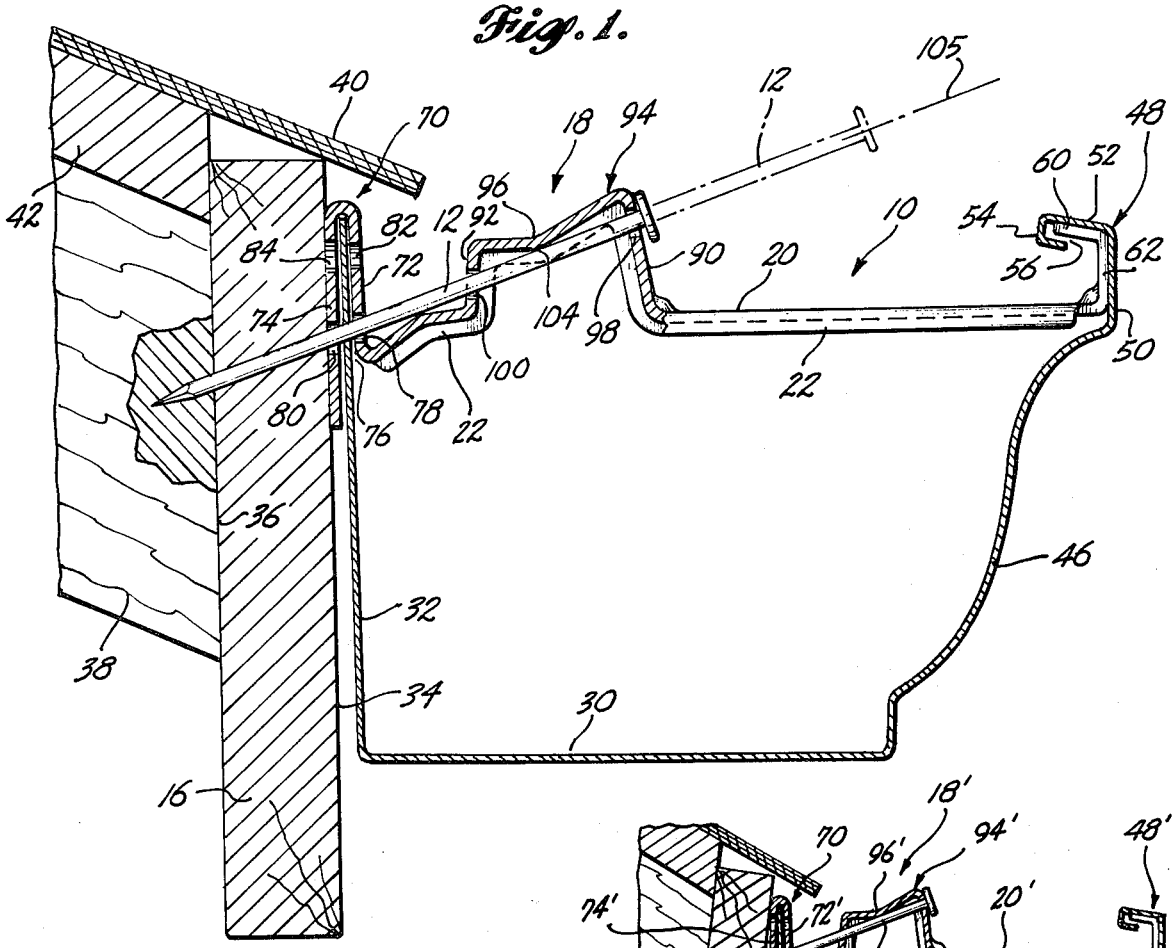
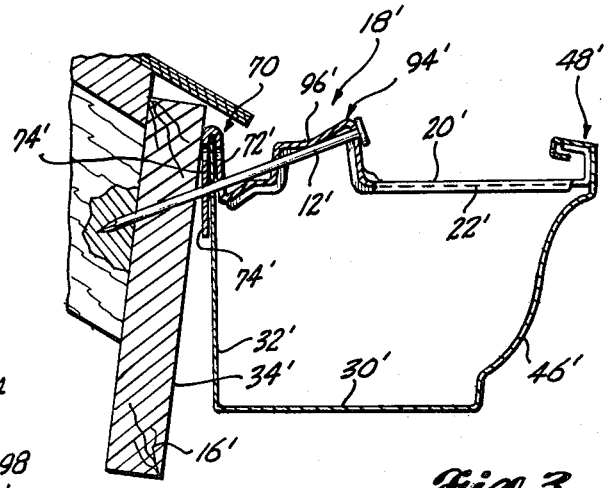
Fig. 3.
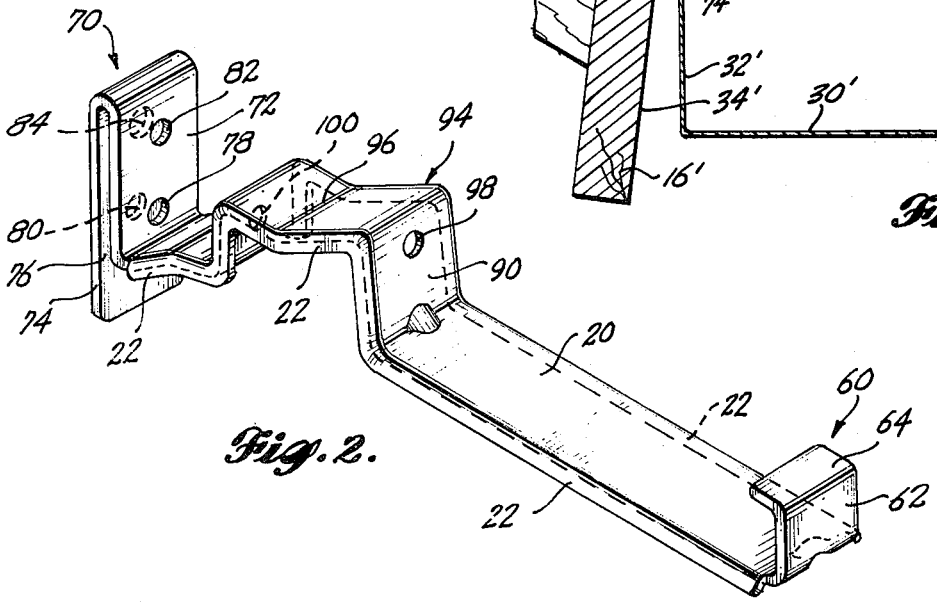
Fig. 2.

GUTTER HANGER

BACKGROUND OF THE INVENTION

1. Field of the Invention

This invention relates to gutter hangers and, in particular, to a gutter hanger having a combined nail guide and support means.

2. Description of the Prior Art

Gutters for building structures and the like are often trough-like structures formed from sheet metal and mounted by various means to the building. The roofs of such buildings are sloped to direct runoff water into a gutter, which is pitched to carry the water away. Various types of gutters and various means of mounting such gutters to buildings are known in the prior art.

A conventional sheet metal gutter is shaped from a thin sheet of aluminum alloy or galvanized steel into an elongated open trough having various cross sections, such as rectangular or semi-circular. One type of commonly used gutter has an inside, or rear, wall which is positioned adjacent the building and extends generaly upwardly parallel to the building surface to which it is attached. A gutter of this type has a front wall forming the opposite side of the trough. The upper margin of the front wall has a lip formed by various bends in the sheet metal structure. Since the walls of the gutter are fabricated from thin sheet metal, some type of bracing means is generally required for maintaining the front and rear wall in a spaced relationship.

One type of mounting bracket includes a bracing means and an attachment means. An arm extending across the width of a gutter includes a hook at one end for engaging and bracing the lip formed on the upper margin of the gutter front wall. At the other end of the arm is a clip for engaging the upper margin of the gutter rear wall. A nail is driven through the rear clip and the upper margin of the rear wall in order to mount the bracket and gutter to the fascia board of a building. If the fascia board is, for some reason not parallel to the gutter rear wall, the gutter rear wall will not lie against the fascia board. Shims or other means must then be provided.

Conventional gutters of the type discussed hereinabove are often mounted near the upper margins of a building wall immediately below the eaves drip line to catch water flowing from the building roof. Fasteners of various kinds, including special gutter-fastening nails, are driven into suitable parts of the building structure, including fascia boards, rafter ends, and the like. Roof shingles and the lower margin of a roof often extend out over the gutter to guide water flow directly into the gutter trough. It is often difficult to find sufficient space to hammer a nail into the upper margin of a gutter mounting near the edge of a roof. A fully driven nail has its head very near the edges of the overhanging shingles. Oftentimes an additional tool such as a nail driver is required to be used to provide access to nails near the upper margin of a gutter. A nail driver is, for example, a hollow tube containing a nail. The nail is driven with a plunger which fits within the hollow tube. One end of the plunger contacts the nail head and the other end of the plunger is driven with a hammer, or the like.

An alternative prior art means for mounting or hanging a conventional gutter includes using a long spike and a long sleeve. The sleeve is horizontally positioned inside the gutter between the upper margins of the front and rear walls. The long spike is driven through the gutter front wall, through the sleeve, through the gutter rear wall, and into the building structure. The gutter walls are not positively engaged by the sleeve and the spike which is frictionally engaged in the building may eventually be worked loose by various water and ice conditions.

SUMMARY OF THE INVENTION

It is therefore an object of this invention to provide an improved gutter hanger. It is another object of this invention to provide a gutter hanger which permits a nail to be driven from the top side of a trough-type gutter from a position near the center of the gutter.

It is another object of this invention to provide a gutter support bracket which provides a nail guide and holding means.

It is another object of this invention to provide a gutter support bracket which permits a nail head to be spaced away from the inside wall of a gutter providing clearance for driving said nail.

It is another object of this invention to provide a gutter hanger bracket which utilizes the fastening nail for additional support to the gutter and hanger bracket.

These and other objects of the invention are achieved in an improved hanger for mounting a gutter lengthwise on a building structure or the like. The hanger includes an elongated member extending across the width of the gutter. At each end of the member is a means for engaging the respective walls of said gutter. A nail guide is positioned intermediate the ends of the bracket and holds a nail in a predetermined angular position with respect to said bracket. These engagement means include a hook for engagement with a slot formed in the upper margin of the outside wall of a gutter. A clip engages the upper margin of the inside wall of a gutter and includes appropriately aligned apertures for receiving a fastener such as a nail. A fastener alignment and guide means is provided intermediate the ends of the hanger member, which guide means also permits the fastener, or nail, to itself provide support to the gutter hanger at a position between the ends of the hanger member. According to one aspect of the invention, the nail guide is formed by raised portions of the hanger which are connected by a cross member and which have aligned apertures formed therein. The connected crosspiece includes a downwardly bent mid-seciton, the inside surface of which contacts a fastener extending through the guide so that the fastener is retained and aligned. The fastener guide portion of the hanger facilitates installation of fasteners by providing access to the fastener at a position spaced away from the inside wall of the gutter. The structure of the fastener guide permits the fastener itself to lend support to the bracket.

BRIEF DESCRIPTION OF THE DRAWINGS

FIG. 1 is a sectional view of a gutter support bracket according to the invention assembled to a gutter and having a nail positioned for attachment to a fascia board;

FIG. 2 is a perspectve view of a gutter support bracket according to the invention; and FIG. 3 is a sectional view of a portion of a gutter support bracket fastened to a mounting surface oriented at an angle with respect to the vertical direction.

DESCRIPTION OF THE PREFERRED EMBODIMENT

Referring to FIG. 1 of the drawings, a hanger bracket 10 and a nail 12 provide a means for easily mounting a conventional sheet metal rain gutter 14 to a fascia board 16. When mounted, the bracket 10 vertically supports a section of the gutter 14. The bracket 10 has a nail guide 18 which retains and guides the nail 12, permitting the nail 12 to be driven at a slight angle into the fascia board 16 from a position near the center of the gutter 14. The design of the bracket allows the nail 12 to support the bracket 10 intermediate its ends, as well as at the end of the bracket abutting fascia board 16.

The gutter 14 shown in FIG. 1 is a conventional sheet metal gutter formed, for example, from an aluminum alloy sheet material. Alternative materials, such as galvanized steel sheet stock, are also used to form gutters of this type. The gutter 14 is an elongated trough having a generally rectangular cross section configuration as shown. A bottom wall 30 extends generally horizontally with respect to a fascia board 16. When mounted to the fascia board, an upwardly extending rear, or inside, wall 32 of the gutter 14 is positioned to face the outside surface 34 of the fascia board 16. The fascia board 16 is shown juxtaposed to the vertical end 36 of a roof rafter 38. Roofing elements, such as asphalt shingles 40 are overlappingly laid on inclined roof boards 42. The ends of the shingles in the lowest row extend out over the fascia board 16 so that water flows down the roof and into the gutter 14 trough. The gutter 14 is lengthwise pitched at a slight angle to direct water flow to a downspout. The fascia board 16 and the building structure shown are exemplary. The fascia board 16 receives the nails 16, but, for example, the gutter may be nailed directly to the ends 36 of the rafters 38 if required. The front wall 46 of the gutter 14 has an upwardly extending reversely curved configuration. While the upper margin of the rear wall 32 is generally planar, the upper margin of the front wall 46 has a lip 48. The lip includes an upwardly extending portion 50 and a connected horizontal portion 52. An inwardly directed channel 54 with an opening 56 is formed at the inside edge of the horizontal portion 52.

FIG. 2 shows the bracket 10 in a perspective view. The bracket 10 is formed, for example, from .065 inch thick aluminum alloy stock of the type commonly used for gutter hangers. The bracket 10 includes a generally elongated member, or arm, 20 which forms the main structure of a bracket and which traverses the width of a gutter. Ribs 22 are formed along the edges of the bracket 10 to provide additional strength to the bracket structure. Other ribbing and dimpling and notching techniques are known in the art and are used to provide additional strength to the bracket, as required.

A C-shaped hook 60 is formed at the end of the bracket 20 arm and is designed to be received in the opening 56 of the gutter lip 48. The hook 60 includes a short upwardly extending portion 62 and an attached inwardly extending portion 64. The hook 60 serves as a means for engaging the upper margin of the outside wall 46 of the gutter 14, as shown in FIG. 1. The hook 60 and the particular configuration of the upper margin of the gutter front wall shown are exemplary and the invention is not limited thereto.

At the other end of the bracket 10 is a clip 70 formed by an upwardly extending portion 72 of the bracket and a reversely bent, downwardly extending portion 74 which form a space 76 for receiving the upper margin of the inside wall 32 of the gutter. A pair of adjacently positioned apertures 78, 80 are formed in the corresponding portions 72, 74 for receiving the nail 12 when it is driven through the upper margin of the inside wall 32 and into the fascia board 16. Another pair of similar apertures 82, 84 are formed in the respective portions 72, 74 above the other pair of apertures. These apertures are provided for optionally nailing the bracket in an application where it is desired to install a nail 12 with its head in close proximity to the clip part of a bracket 10. Aperture 84 is somewhat larger than aperture 82 to permit a certain amount of misalignment of a nail being driven through apreture 82.

The nail guide portion 18 of the bracket 10 is located intermediate the ends of the bracket and is formed as an integral part of the bracket arm 20. The nail guide 18 has a generally upright front section 90 which is positioned near the middle of the bracket 18. A somewhat shorter, generally upright rear section 92 extends upwardly from the rear portion of the arm 22. A crosspiece 94 having a downwardly bent midsection 96 connects the top ends of the upright members 90, 92. A first aperture 98 and a second aperture 100 are respectively formed in the front and rear sections 90, 92 of the nail guide 18. The apertures are positioned along an axis 105 to align with the apertures 78, 80 in the clip 70. A nail passing through the guide member apertures along the axis 105 contacts the inside surface 104 of the bent midsection 96. The nail 12 is thereby held and aligned by the guide member 18, which in this embodiment is M-shaped with surface 104 being the interior surface of the middle apex of the configuration. The axis of alignment 105 is placed at an angle of approximately 20° with respect to the front portion of arm 22 to provide clearance for an installation tool, such as a hammer.

FIG. 1 shows a bracket 10 assembled to the gutter 14. This is accomplished by holding the bracket in a generally vertical position and engaging the hook 60 in the opening 56 of the gutter front wall lip 48. The bracket 10 is pivoted about the lip 48 so that the clip 70 slides over the upper margin of the rear wall 32. A nail 12, such as, for example, an aluminum gutter-fastening nail, is then angularly positioned through the nail guide member 18 as shown in FIG. 2. When a nail is finally driven into the fascia board 16, the head of the nail 12 is positioned next to the guide 18 and away from the fascia board surface 34. This configuration allows an installer to easily mount a gutter 14 because nails 12 are held in an upright angular position with respect to the guide member. Adequate clearance for a hammer, or other nail-driving instrument, is provided because the head of a driven nail is spaced away from the inside wall 32 of the gutter 14. The edges of shingles 40 are not damaged and installation of a gutter is greatly facilitated. Note that if for some reason an operator wishes to nail directly through the clip 70 without using the nail guide 18, apertures 82, 84 are alternatively provided.

Often, aluminum gutters are continuously formed on an installation site from rolls of flat aluminum stock. As a gutter section is exiting the forming machine, an operator snaps a bracket 12 onto the gutter every few feet, as required. Each bracket 12 has a nail 12 assembled and positioned in the guide portion 18. No further assembly and/or positioning of the bracket and nails are required. The gutter with its preassembled brackets and fasteners is merely placed in position and the preassembled fastener nails are easily driven into place from the top-center area of the gutter. Obviuosly, gutter installation is thereby made faster and more convenient. The nail guide structure of the bracket 12 also permits the nail 12 to function as a cantilever support member for the bracket 10. The nail provides support to the bracket intermediate the ends of the bracket 10. The bracket 12 also facilitates installation of a gutter to a fascia board which is canted or angled away from the vetical plane. FIG. 3 shows a fascia board 16' into which a fastening nail 12' is driven. The nail 12' provides support for the bracket 10'. The fascia board 16' is oriented at an angle with respect to the vertical direction. However, using a bracket 12' according to the invention permits a gutter to be mounted with a substantially upright orientation, that is, with the rear wall 32' of a gutter 10' in a substantially vertical plane so that the bottom wall of the gutter is horizontally positioned. It can readily be appreciated that the need for shims or the like for leveling a gutter is eliminated by using a hanger bracket according to the invention.

While a particular embodiment of the invention has been shown and described, it should be understood that the invention is not limited thereto since many modifications may be made. It is therefore contemplated to cover by the present application any and all such modifications that fall within the true spirit and scope of the basic underlying principles disclosed and claimed herein.

I claim:

1. A hanger for mounting a gutter to a structure with a fastener, comprising:

a hanger member extending across the width of said gutter comprising a substantially horizontally disposed bracket arm and a raised fastener guide portion;

first means attached to one end of said bracket arm for engaging the outside wall of said gutter; and second means attached to one end of said fastener guide portion for engaging the inside wall of said gutter and for receiving said fastener to mount said gutter to said structure;

said raised fastener guide portion comprising a first upright section extending upwardly from said bracket arm, a second upright section extending upwardly from said hanger member, a connecting crosspiece between said first upright section and said second connecting crosspiece including a downwardly bent mid-section for engaging and retaining a fastener extending through said fastener guide portion, said upright sections having apertures formed therein for receiving said fastener.

2. The hanger of claim 1 wherein the hanger member is an elongated member formed from sheet metal stock and having a raised portion formed along its length providing additional strength.

3. The hanger of claim 1 wherein the first means includes a hook for engaging a slot formed in the upper margin of the outside wall of the gutter.

4. The hanger of claim 3 wherein the hook is a C-shaped member having a reversely bent end which engages a correspondingly formed portion in the upper margin of the outside wall of the gutter.

5. The hanger of claim 1 wherein the second means includes a clip engaging the upper margin of the inside wall of the gutter, the clip having aperture means formed therein for receiving said fastener.

6. The hanger of claim 5 wherein the clip includes an upwardly extending portion connectd to the hanger member and a connected downwardly extending portion which both form a space for receiving the upper margin of the inside wall of the gutter and wherein the aperture means includes apertures in each extending portion aligned adjacently for receiving said fastener when said fastener is driven into the structure.

7. The hanger of claim 1 wherein said apertures in said upright section of said raised fastener guide portion align with a fastener receiving aperture means formed in said second means.

8. A hanger for supporting a gutter on a structure with a fastener, said gutter having an outside lip and an inside wall, said hanger comprising:

an elongated member extending widthwise to said gutter;

hook means at one end of the elongated member for engaging the outside lip of said gutter;

clip means at the other end of the elongated member for engaging the inside wall of said gutter, said clip means having an upwardly extending portion and a connected, reversely bent, downwardly extending portion said portions having mutually aligned apertures for receiving said fastener, said portions forming a space for receiving and gripping the inside wall of said gutter; and a fastener guide intermediate the ends of said elongated member, said fastener guide being M-shaped with the interior surface of the middle apex thereof contacting and securely retaining a fastener extending therethrough and having an aperture formed therein for receiving and aligning said fastener in an angular relationship with said elongated member thereby providing sufficient clearance for driving the fastener and thereby providing that a fastener partially driven into said structure supports the hanger intermediate the ends of said elongated member.

* * * * *